US011054156B2

(12) United States Patent
Yamamoto et al.

(10) Patent No.: US 11,054,156 B2
(45) Date of Patent: Jul. 6, 2021

(54) OUTDOOR UNIT AND AIR CONDITIONER INCLUDING THE SAME

(71) Applicant: Mitsubishi Electric Corporation, Tokyo (JP)

(72) Inventors: Katsuyuki Yamamoto, Tokyo (JP); Takuya Teramoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 51 days.

(21) Appl. No.: 15/779,925

(22) PCT Filed: Jan. 25, 2016

(86) PCT No.: PCT/JP2016/051999
§ 371 (c)(1),
(2) Date: May 30, 2018

(87) PCT Pub. No.: WO2017/130273
PCT Pub. Date: Aug. 3, 2017

(65) Prior Publication Data

US 2018/0363928 A1 Dec. 20, 2018

(51) Int. Cl.

| | |
|---|---|
| ***F24F 1/38*** | (2011.01) |
| ***F24F 1/54*** | (2011.01) |
| ***F24F 1/40*** | (2011.01) |

(52) U.S. Cl.
CPC ..... *F24F 1/38* (2013.01); *F24F 1/40* (2013.01); *F24F 1/54* (2013.01)

(58) Field of Classification Search
CPC ..... F24F 1/38; F24F 1/40; F24F 1/54; F04D 29/54
See application file for complete search history.

(56) References Cited

U.S. PATENT DOCUMENTS 5,248,224 A * 9/1993 Amr ..... F04D 29/547 415/223
6,450,760 B1 * 9/2002 Furukawa ..... F04D 29/384 415/119

(Continued)

FOREIGN PATENT DOCUMENTS

CN 202835597 U 3/2013
CN 104024746 A 9/2014

(Continued)

OTHER PUBLICATIONS

Office action dated Jun. 25, 2019 issued in corresponding EP patent application No. 2017-563415 (and English translation thereof).

(Continued)

*Primary Examiner* — Kun Kai Ma
(74) *Attorney, Agent, or Firm* — Posz Law Group, PLC

(57) ABSTRACT

A heat exchanger, an axial-flow fan, a bell mouth, a fan motor, and a baffle plate are disposed in a casing of an outdoor unit. The casing includes a front panel provided with an air outlet, and a rear panel provided with an air inlet. The bell mouth and the baffle plate are disposed on an inner surface of the front panel. The bell mouth has a first opening opened toward the heat exchanger, and a second opening opened toward the air outlet. The baffle plate is disposed to incline from a predetermined position on the inner surface of the front panel toward where the bell mouth is disposed.

15 Claims, 16 Drawing Sheets

(56) References Cited

U.S. PATENT DOCUMENTS

| | | | | |
|---|---|---|---|---|
| 6,503,060 | B1 * | 1/2003 | Kamada | F04D 29/703 415/121.2 |
| 8,221,074 | B2 * | 7/2012 | Nelson | F04D 29/646 415/213.1 |
| 10,386,083 | B2 * | 8/2019 | Kasugai | F24F 1/38 |
| 2007/0036648 | A1 * | 2/2007 | Obosu | F04D 29/545 415/222 |
| 2008/0159872 | A1 * | 7/2008 | Park | F04D 25/0613 416/244 R |
| 2009/0193831 | A1 * | 8/2009 | Kim | F04D 29/526 62/259.1 |
| 2010/0319380 | A1 * | 12/2010 | Mochizuki | F24F 1/06 62/259.1 |
| 2011/0017427 | A1 * | 1/2011 | Kato | F04D 29/164 165/59 |
| 2014/0299298 | A1 * | 10/2014 | Kono | F24F 1/40 165/121 |
| 2015/0121933 | A1 * | 5/2015 | Yamaguchi | F24F 1/16 62/275 |
| 2015/0121934 | A1 * | 5/2015 | Yamaguchi | F24F 1/06 62/275 |
| 2015/0204599 | A1 * | 7/2015 | Chisaki | F24F 1/06 62/426 |
| 2015/0247649 | A1 * | 9/2015 | Tanikawa | F24F 1/46 62/298 |
| 2016/0003487 | A1 * | 1/2016 | Iwase | F04D 29/386 165/122 |

FOREIGN PATENT DOCUMENTS

| | | | | |
|---|---|---|---|---|
| CN | 204787121 | U | 11/2015 | |
| JP | S57-053976 | Y | 11/1982 | |
| JP | H01-178526 | U | 12/1989 | |
| JP | H04-278132 | A | 10/1992 | |
| JP | H04-132337 | U | 12/1992 | |
| JP | H10-094832 | A | 4/1998 | |
| JP | 3057259 | U | 4/1999 | |
| JP | 2004-150654 | A | 5/2004 | |
| JP | 2004-211931 | A | 7/2004 | |
| JP | 2006077585 | A * | 3/2006 | |
| JP | 2006-214690 | A | 8/2006 | |
| JP | 2010127590 | A * | 6/2010 | |
| JP | 2011-179778 | A | 9/2011 | |
| JP | 2013-079595 | A | 5/2013 | |
| WO | WO-2009130954 | A1 * | 10/2009 | F24F 1/38 |
| WO | WO-2010053037 | A1 * | 5/2010 | F24F 1/38 |
| WO | WO-2012035577 | A1 * | 3/2012 | F24F 1/38 |
| WO | WO-2014128908 | A1 * | 8/2014 | F04D 29/666 |

OTHER PUBLICATIONS

International Search Report of the International Searching Authority dated Apr. 19, 2016 for the corresponding international application No. PCT/JP2016/051999 (and English translation).

Extended European Search Report dated Nov. 30, 2018 issued in corresponding EP patent application No. 16887860.1.

Office Action dated Apr. 1, 2019 issued in corresponding AU patent application No. 2016389531.

Office Action dated Oct. 22, 2019 issued in corresponding in patent application No. 201847024776 (and English translation).

Office Action dated Nov. 28, 2019 issued in corresponding KR patent application No. 10-2018-7017785 (and English translation).

Office Action dated Jan. 7, 2020 issued in corresponding JP patent application No. 2017-563415 (and English translation).

Office Action dated Jan. 6, 2020 issued in corresponding CN patent application No. 201680078555.5 (and English translation).

* cited by examiner

OUTDOOR UNIT AND AIR CONDITIONER INCLUDING THE SAME

CROSS REFERENCE TO RELATED APPLICATION

This application is a U.S. national stage application of PCT/JP2016/051999 filed on Jan. 25, 2016, the contents of which are incorporated herein by reference.

TECHNICAL FIELD

The present invention relates to an outdoor unit and an air conditioner including the same, and in particular to an outdoor unit including an axial-flow fan and an air conditioner including such an outdoor unit.

BACKGROUND ART

In an outdoor unit of an air conditioner, heat exchange is performed between refrigerant flowing through a heat exchanger and air passing through the heat exchanger. In the outdoor unit, an axial-flow fan is attached to deliver air into the heat exchanger. A bell mouth is provided around an outer circumference of the axial-flow fan. In order to smoothly guide air to the axial-flow fan, an upper baffle plate is provided above the axial-flow fan, and a lower baffle plate is provided below the axial-flow fan.

Air flows into the outdoor unit by rotation of the axial-flow fan, and the air flowing therein passes through the heat exchanger. The air passing through the heat exchanger flows toward the axial-flow fan, and is exhausted out of the outdoor unit. The upper baffle plate and the lower baffle plate are disposed from the heat exchanger toward the bell mouth. PTD 1 is an exemplary patent document which discloses such an outdoor unit.

CITATION LIST

Patent Document

PTD 1: Japanese Patent Laying-Open No. 2004-211931

SUMMARY OF INVENTION

Technical Problem

In an outdoor unit of an air conditioner, it is required to reduce ventilation resistance when air flows and suppress noise of the outdoor unit.

The present invention has been made as part of development thereof. One object of the present invention is to provide an outdoor unit which achieves further reduction in ventilation resistance, and another object of the present invention is to provide an air conditioner including such an outdoor unit.

Solution to Problem

An outdoor unit in accordance with the present invention includes a casing, a heat exchanger, a blowing unit, a bell mouth, and a baffle plate. The casing includes a first wall portion having an air inlet, and a second wall portion having an air outlet. The heat exchanger is disposed in the casing to face the air inlet. The blowing unit includes an axial-flow fan disposed between the heat exchanger and the second wall portion. The bell mouth is disposed on an inner surface of the second wall portion to communicate with the air outlet and circumferentially surround the axial-flow fan. The baffle plate is attached to a position on the inner surface of the second wall portion and disposed to incline from the position toward where the bell mouth is disposed.

An conditioner in accordance with the present invention is an air conditioner including the outdoor unit according to claim 1.

Advantageous Effects of Invention

In the outdoor unit in accordance with the present invention, the baffle plate is attached to a position on the inner surface of the second wall portion and disposed to incline from the position toward where the bell mouth is disposed. Thus, air passing through the heat exchanger and colliding with the second wall portion flows along the baffle plate and is guided to the bell mouth. Thereby, ventilation resistance in the outdoor unit can be reduced, and noise of the outdoor unit can be reduced.

Since the air conditioner in accordance with the present invention includes the outdoor unit according to claim 1, ventilation resistance in the outdoor unit can be reduced, and efficiency of heat exchange in the outdoor unit can be increased.

DESCRIPTION OF EMBODIMENTS

Figure 1:
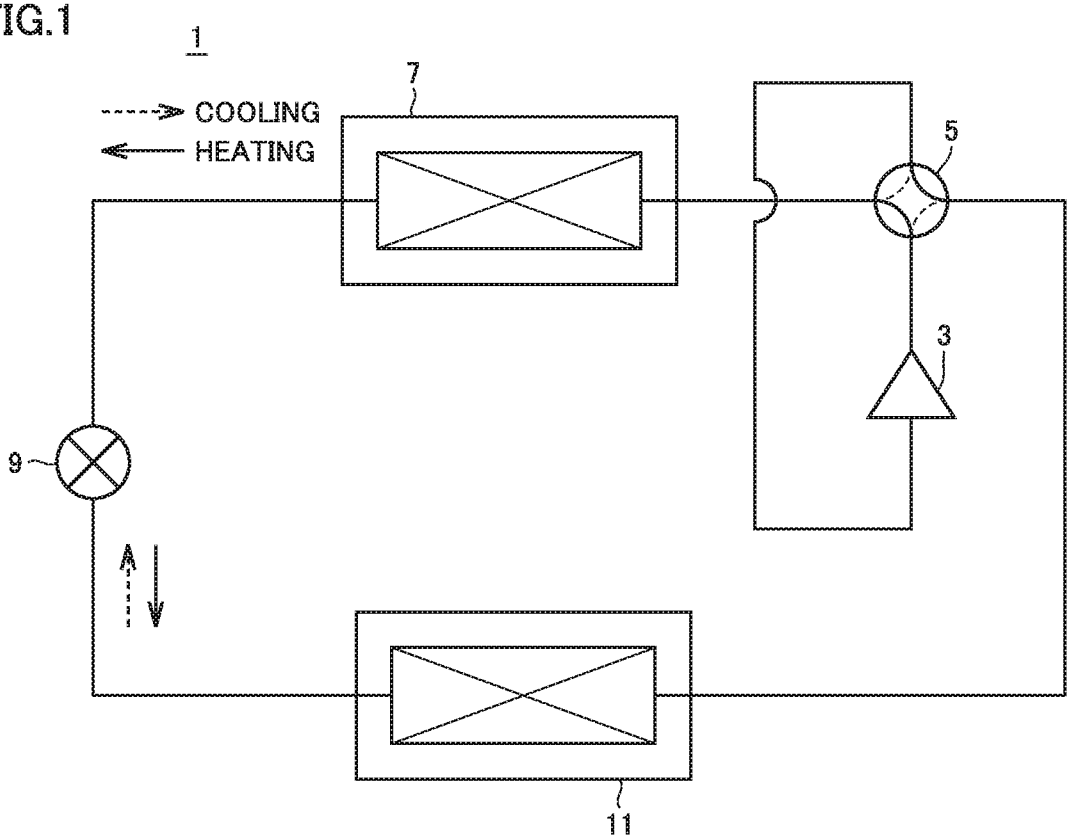
FIG. 1 is a view showing a refrigerant circuit of an air conditioner in accordance with each embodiment.

First, an entire configuration (a refrigerant circuit) of an air conditioner including an outdoor unit will be described. As shown in FIG. 1, an air conditioner 1 includes a compressor 3, a four-way valve 5, an indoor unit 7, a throttle device 9, and an outdoor unit 11. Compressor 3, four-way valve 5, indoor unit 7, throttle device 9, and outdoor unit 11 are connected by a refrigerant pipe.

Next, a flow of refrigerant in a case where air conditioner 1 described above performs cooling operation will be described. As shown in FIG. 1, by driving compressor 3, refrigerant in a high-temperature high-pressure gas state is discharged from compressor 3. The discharged high-temperature high-pressure gas refrigerant (single phase) flows into outdoor unit 11 via four-way valve 5. In outdoor unit 11, heat exchange is performed between the refrigerant flowing therein and air delivered into outdoor unit 11, and the high-temperature high-pressure gas refrigerant is condensed into high-pressure liquid refrigerant (single phase).

By means of throttle device 9, the high-pressure liquid refrigerant delivered from outdoor unit 11 turns into refrigerant in a two-phase state including low-pressure gas refrigerant and liquid refrigerant. The refrigerant in the two-phase state flows into indoor unit 7. In indoor unit 7, heat exchange is performed between the refrigerant in the two-phase state flowing therein and air delivered into indoor unit 7, the liquid refrigerant evaporates, and thus the refrigerant in the two-phase state turns into low-pressure gas refrigerant (single phase). The interior of a room is cooled by this heat exchange. The low-pressure gas refrigerant delivered from indoor unit 7 flows into compressor 3 via four-way valve 5, is compressed into high-temperature high-pressure gas refrigerant, and is discharged again from compressor 3. This cycle is repeated thereafter.

Next, a flow of refrigerant in a case where air conditioner 1 described above performs heating operation will be described. As shown in FIG. 1, by driving compressor 3, refrigerant in a high-temperature high-pressure gas state is discharged from compressor 3. The discharged high-temperature high-pressure gas refrigerant (single phase) flows into indoor unit 7 via four-way valve 5. In indoor unit 7, heat exchange is performed between the gas refrigerant flowing therein and air delivered into indoor unit 7, and the high-temperature high-pressure gas refrigerant is condensed into high-pressure liquid refrigerant (single phase). The interior of the room is heated by this heat exchange. By means of throttle device 9, the high-pressure liquid refrigerant delivered from indoor unit 7 turns into refrigerant in a two-phase state including low-pressure gas refrigerant and liquid refrigerant.

The refrigerant in the two-phase state flows into outdoor unit 11. In outdoor unit 11, heat exchange is performed between the refrigerant in the two-phase state flowing therein and air delivered into outdoor unit 11, the liquid refrigerant evaporates, and thus the refrigerant in the two-phase state turns into low-pressure gas refrigerant (single phase). The low-pressure gas refrigerant delivered from outdoor unit 11 flows into compressor 3 via four-way valve 5, is compressed into high-temperature high-pressure gas refrigerant, and is discharged again from compressor 3. This cycle is repeated thereafter.

Figure 2:
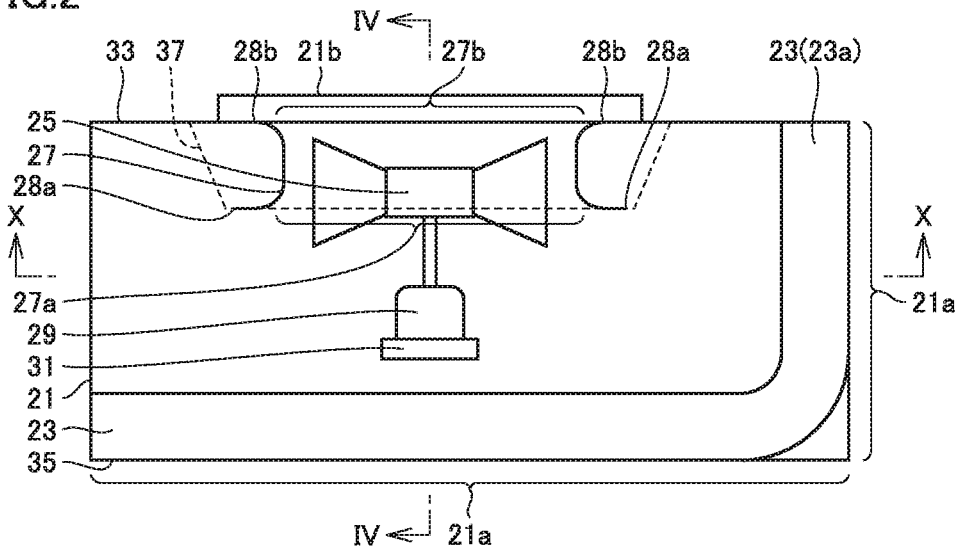
FIG. 2 is a top view for illustrating an overview of a configuration in a casing of an outdoor unit in accordance with each embodiment.
Figure 3:
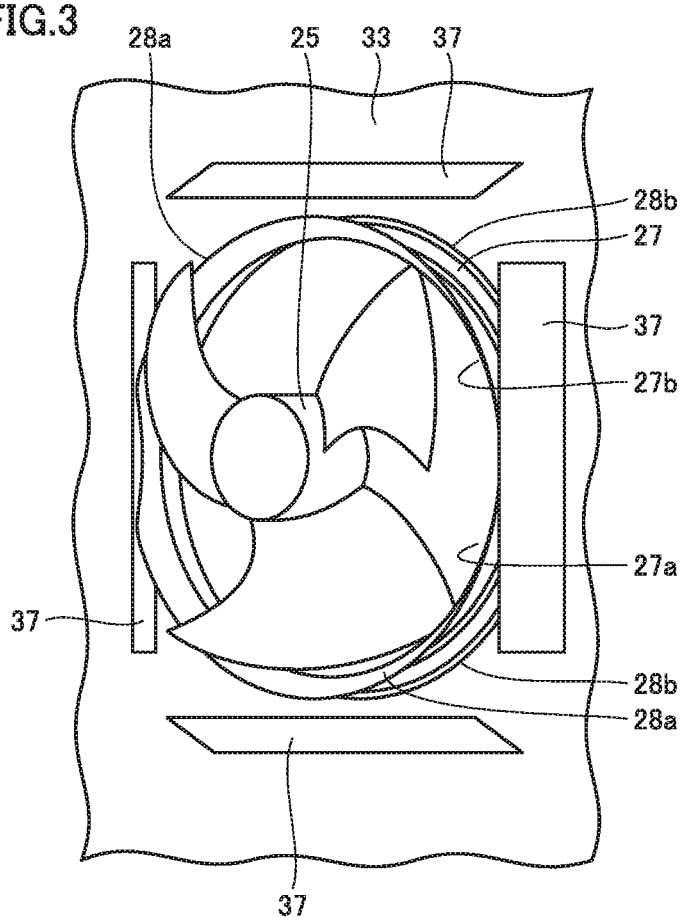
FIG. 3 is a partially enlarged perspective view showing elements disposed on an inner surface of a front panel of the outdoor unit in accordance with each embodiment.

Next, an overview of outdoor unit 11 of air conditioner 1 will be described. As shown in FIGS. 2 and 3, a heat exchanger 23, an axial-flow fan 25, a bell mouth 27, and a fan motor 29 are disposed in a casing 21 of outdoor unit 11.

Casing 21 includes a front panel 33 (second all portion) and a rear panel 35 (first wall portion). Rear panel 35 is provided with an air inlet 21*a* for introducing air into casing 21. Front panel 33 is provided with an air outlet 21*b* for exhausting the air introduced into casing 21. It should be noted that front panel 33 and rear panel 35 may be formed as separate elements, or may be integrally formed as casing 21.

Heat exchanger 23 is disposed to face air inlet 21*a*. Axial-flow fan 25 and fan motor 29 are disposed between heat exchanger 23 and front panel 33. Fan motor 29 is fixed to a motor support 31.

Bell mouth 27 and a baffle plate 37 are disposed on an inner surface (inner side) of front panel 33. Bell mouth 27 is disposed to circumferentially surround axial-flow fan 25. Bell mouth 27 has a first opening 27*a* opened toward heat exchanger 23, and a second opening 27*b* opened toward air outlet 21*b*. Second opening 27*b* communicates with air outlet 21*b*.

Baffle plate 37 is attached to a predetermined position on the inner surface of front panel 33 spaced from bell mouth 27, and is disposed to incline from that position toward where bell mouth 27 is disposed. Further, baffle plate 37 includes a portion extending from the predetermined position on the inner surface of front panel 33 spaced from an outer circumferential end 28*b* of second opening 27*b* in a radial direction of axial-flow fan 25, toward an outer circumferential end 28*a* of first opening 27*a* of bell mouth 27. It should be noted that substantive baffle plate 37 shown in FIG. 2 is an example, and the baffle plate is not limited to this baffle plate 37.

Hereinafter, a concrete structure of baffle plate 37 of outdoor unit 11 will be described in each embodiment. It should be noted that, in each drawing of each embodiment, members identical to those shown in FIGS. 2 and 3 will be designated by the same reference numerals, and the description thereof will not be repeated, unless otherwise required.

First Embodiment

Figure 4:
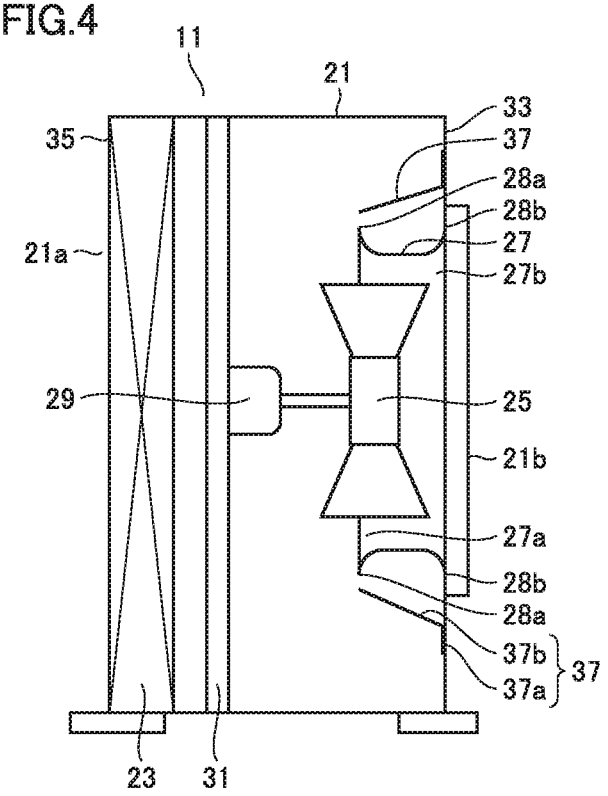
FIG. 4 is a cross sectional view of an outdoor unit in accordance with a first embodiment, in a section line corresponding to a section line IV-IV shown in FIG. 2.

A first example of the outdoor unit will be described. As shown in FIG. 4, baffle plate 37 is attached to a predetermined position on the inner surface of front panel 33 spaced from outer circumferential end 28*b* of second opening 27*b*, and is disposed to incline from that position toward outer circumferential end 28*a* of first opening 27*a* of bell mouth 27. Baffle plate 37 includes an attached portion 37*a* and an inclined portion 37*b*. Attached portion 37*a* is fixed to the inner surface of front panel 33. Inclined portion 37*b* is disposed at a predetermined angle with respect to attached portion 37*a*.

A distance (height) from the inner surface of front panel 33 to an end portion of baffle plate 37 closer to heat exchanger 23 is set to be substantially the same as a distance (height) from the inner surface of front panel 33 to outer circumferential end 28*a* of bell mouth 27. Further, baffle plate 37 is formed as an element separate from bell mouth 27, and they are disposed as separate parts on front panel 33.

In outdoor unit 11 described above, since baffle plate 37 is disposed from front panel 33 toward outer circumferential end 28*a* of bell mouth 27, ventilation resistance can be suppressed and noise can be reduced. This will be described in comparison with an outdoor unit in accordance with a comparative example.

Figure 5:
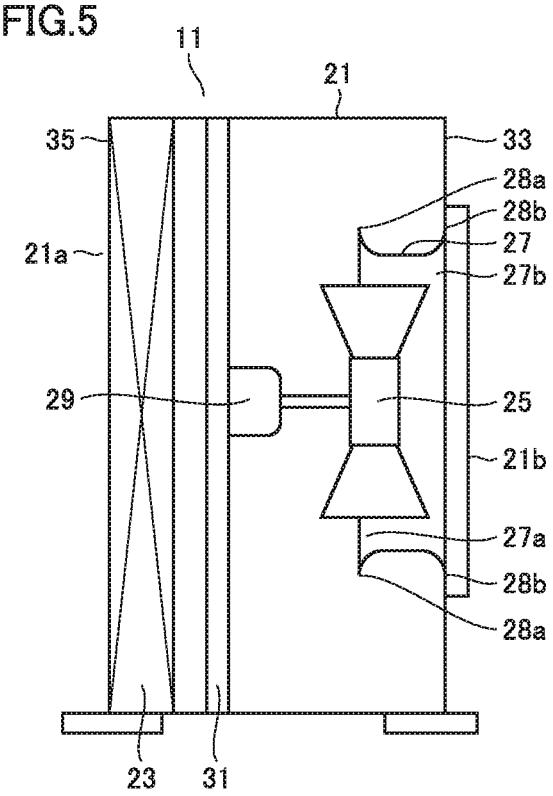
FIG. 5 is a cross sectional view showing an outdoor unit in accordance with a comparative example.

As shown in FIG. 5, outdoor unit 11 in accordance with the comparative example has the same structure as that of outdoor unit 11 shown in FIG. 4 except that no baffle plate is disposed. Accordingly, members identical to those shown in FIG. 4 will be designated by the same reference numerals, and the description thereof will not be repeated, unless otherwise required.

Figure 6:
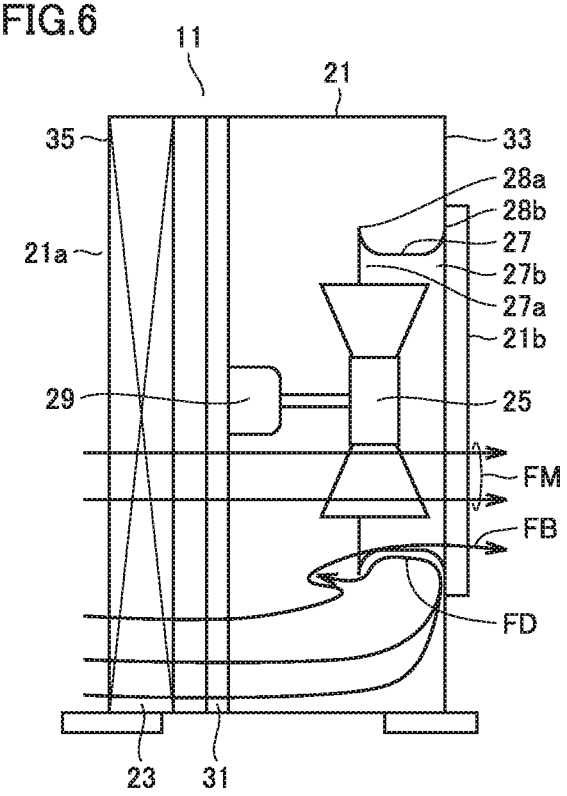
FIG. 6 is a cross sectional view for illustrating operation of the outdoor unit in accordance with the comparative example.

Next, operation of outdoor unit 11 in accordance with the comparative example will be described. Along with operation of an air conditioner (see FIG. 1), axial-flow fan 25 of outdoor unit 11 rotates. As shown in FIG. 6, air is introduced from air inlet 21*a* into casing 21 by the rotation of axial-flow fan 25. In casing 21, a flow of air from heat, exchanger 23 toward axial-flow fan 25 (bell mouth 27) is produced.

Of the air passing through heat exchanger 23, air flowing in the vicinity of the central axis of axial-flow fan 25 directly flows toward axial-flow fan 25, passes through bell mouth 27 (axial-flow fan 25), and is exhausted out of casing 21 from air outlet 21*b* (see arrows FM).

On the other hand, as air flows through a region (position) more spaced from axial-flow fan 25 in the radial direction, the air has less power to be sucked by axial-flow fan 25. Thus, the air passing through heat exchanger 23 once collides with front panel 33. The air colliding with front panel 33 flows along front panel 33, and then flows along an outer wall (outer circumferential surface) of bell mouth 27.

Accordingly, a flow of air concentrates on the inner surface of front panel 33 and the outer wall of bell mouth 27, and the air flows faster. Thus, the air (flow) separates at the outer wall close to first opening 27*a* of bell mouth 27 (see an arrow FD). The air separated from the outer wall of bell mouth 27 is influenced by the shape of bell mouth 27 and by air suction by axial-flow fan 25, and flows toward heat exchanger 23 as a backflow.

Thus, air which originally attempts to be sucked by axial-flow fan 25 and flow along bell mouth 27 (an inner circumferential surface) is pushed back by the air which attempts to flow toward heat exchanger 23 (see an arrow FB). Accordingly, the amount of air passing through bell mouth 27 is reduced, and separation of the air (flow) further occurs at the outer wall close to first opening 27*a* of bell mouth 27. As a result, ventilation resistance in outdoor unit 11 increases.

Operation of the outdoor unit in accordance with the first embodiment will be described relative to the outdoor unit in accordance with the comparative example. In outdoor unit 11 in accordance with the first embodiment, the baffle plate is attached to the predetermined position on the inner surface of front panel 33, and is disposed to incline from that position toward outer circumferential end 28*a* of bell mouth 27 (see FIG. 4).

Figure 7:
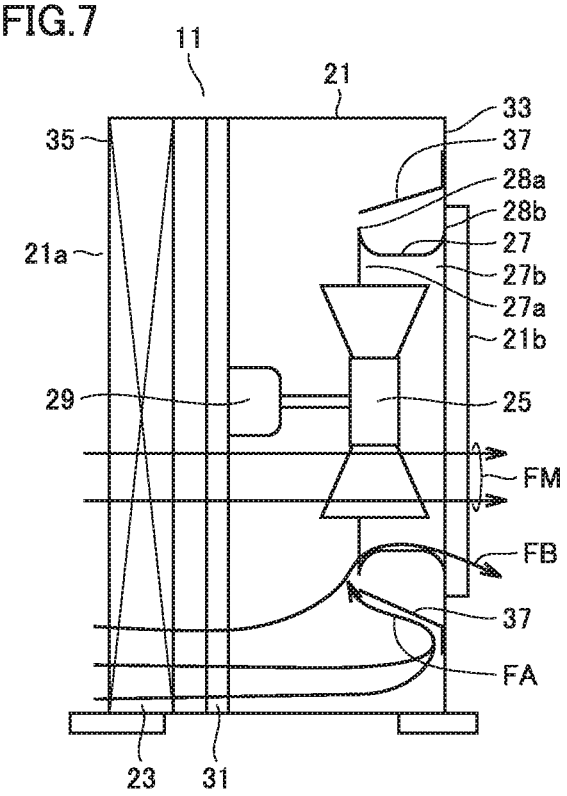
FIG. 7 is a cross sectional view for illustrating operation of the outdoor unit in the first embodiment.

As shown in FIG. 7, of the air passing through heat exchanger 23, air flowing in the vicinity of the central axis of axial-flow fan 25 directly flows toward axial-flow fan 25, passes through bell mouth 27 (axial-flow fan 25), and is exhausted out of casing 21 from air outlet 21*b* (see arrows FM).

On the other hand, air flowing through a region (position) spaced from the central axis of axial-flow fan 25 in the radial direction has less power to be sucked by axial-flow fan 25, and the air once collides with front panel 33. The air colliding with front panel 33 flows along baffle plate 37, and is guided to first opening 27*a* of bell mouth 27.

This can suppress the air colliding with front panel 33 from attempting to flow along the outer wall (outer peripheral surface) of bell mouth 27, and reduce separation of the air (flow) at the outer wall close to first opening 27*a* of bell mouth 27. As a result, ventilation resistance caused by the separation of the air (flow) can be reduced. In addition, since the ventilation resistance is reduced, efficiency of heat exchange in outdoor unit 11 can be increased, and noise of outdoor unit 11 can be reduced.

In addition, as an outdoor unit in accordance with another comparative example (not shown), in an outdoor unit having a baffle plate disposed between a heat exchanger and a bell mouth, it is conceivable that the baffle plate disposed in the vicinity of the heat exchanger causes an increase in ventilation resistance due to obstruction of a flow of air from an air inlet toward the heat exchanger.

In contrast, in outdoor unit 11 in accordance with the first embodiment, baffle plate 37 is disposed to incline from the predetermined position on the inner surface of front panel 33 toward outer circumferential end 28*a* of bell mouth 27. This does not obstruct a flow of air from air inlet 21*a* toward heat exchanger 23, and causes no increase in ventilation resistance due to obstruction of the flow of air.

Further, baffle plate 37 of outdoor unit 11 in accordance with the first embodiment is formed as an element separate from bell mouth 27. This facilitates manufacturing and can contribute to reduction of manufacturing cost, when compared with a case where a baffle plate and a bell mouth having a complicated shape are formed by integral molding.

Second Embodiment

Figure 8:
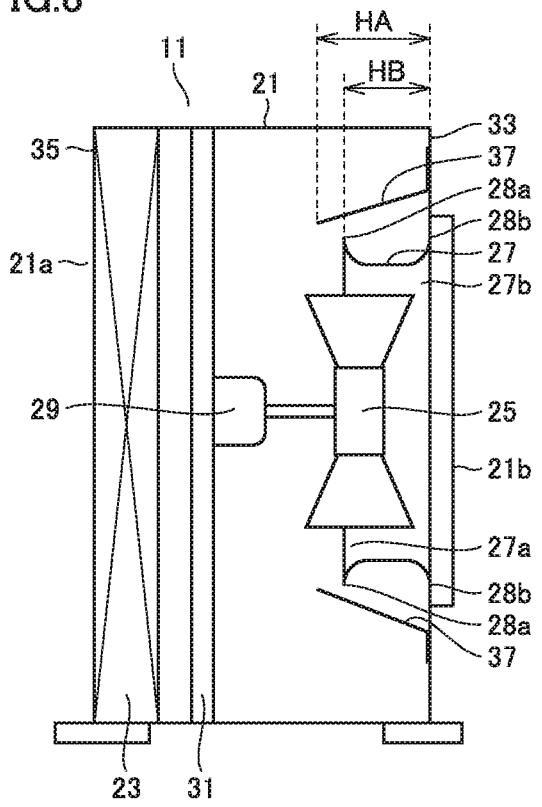
FIG. 8 is a cross sectional view of an outdoor unit in accordance with a second embodiment, in a section line corresponding to section line IV-IV shown in FIG. 2.

A second example of the outdoor unit will be described. As shown in FIG. 8, bell mouth 27 and baffle plate 37 are disposed on the inner surface of front panel 33. A distance HA (height) from the inner surface of front panel 33 to the end portion of baffle plate 37 closer to heat exchanger 23 is set to be longer than a distance HB (height) from the inner surface of front panel 33 to outer circumferential end 28*a* of first opening 27*a* of bell mouth 27. A distance (difference in height: HA−HB) from outer circumferential end 28*a* of bell mouth 27 to the end portion of baffle plate 37 closer to heat exchanger 23 is about 30 mm to 50 mm, for example.

An upper limit value of this distance (difference in height) should be set to a distance at which a flow of air is not obstructed by baffle plate 37 itself. On the other hand, a lower limit value of this distance should be set to a distance which allows air flowing backward to flow between the outer wall of bell mouth 27 and baffle plate 37, as described below.

Figure 9:
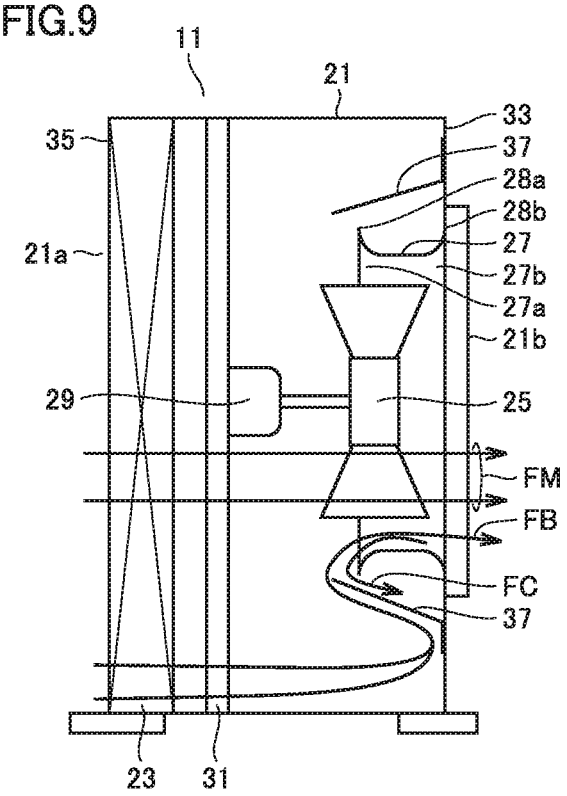
FIG. 9 is a cross sectional view for illustrating operation of the outdoor unit in the second embodiment.
Figure 10:
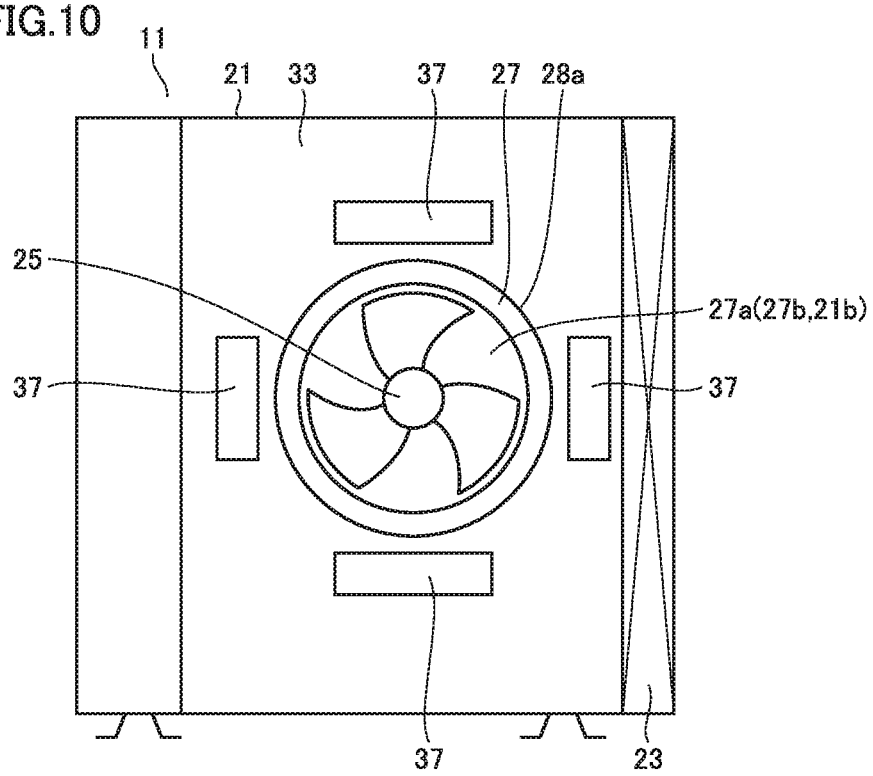
FIG. 10 is a cross sectional view of an outdoor unit in accordance with a third embodiment, in a section line corresponding to a section line X-X shown in FIG. 2.

Next, operation of outdoor unit 11 described above will be described. First, an overall flow of air in casing 21 is as described in the first embodiment. In outdoor unit 11 of air conditioner 1, ventilation resistance of heat exchanger 23 or the like may increase, depending on the operation state. In such an operation state, a centrifugal component of a flow of air blown out from axial-flow fan 25 may relatively increase. In that case, as shown in FIG. 9, air flows back toward front panel 33 at a wall surface (outer peripheral surface) of bell mouth 27 (see an arrow FC). This backflow of air will be described in more detail in an eleventh embodiment.

In outdoor unit 11 described above, the height (distance HA) of baffle plate 37 is set to be greater than the height (distance HB) of the bell mouth. Thereby, the air which attempts to flow back toward front panel 33 flows into between the outer wall (outer peripheral surface) of bell mouth 27 and baffle plate 37. As a result, this can prevent a situation where air which collides with front panel 33 and attempts to flow along baffle plate 37 toward bell mouth 27 collides with the air which attempts to flow backward and thus its flow is obstructed, further reducing the ventilation resistance. In addition, since the ventilation resistance is reduced, efficiency of heat exchange in outdoor unit 11 can be increased, and noise of outdoor unit 11 can be reduced.

Third Embodiment

A third example of the outdoor unit will be described. As shown in 10, when viewed in plan view toward the inner surface of front panel 33, baffle plates 37 are disposed above and below bell mouth 27 to sandwich bell mouth 27 from above and below directions. In addition, baffle plates 37 are disposed to the right and left of bell mouth 27 to sandwich bell mouth 27 from right and left directions.

Figure 11:
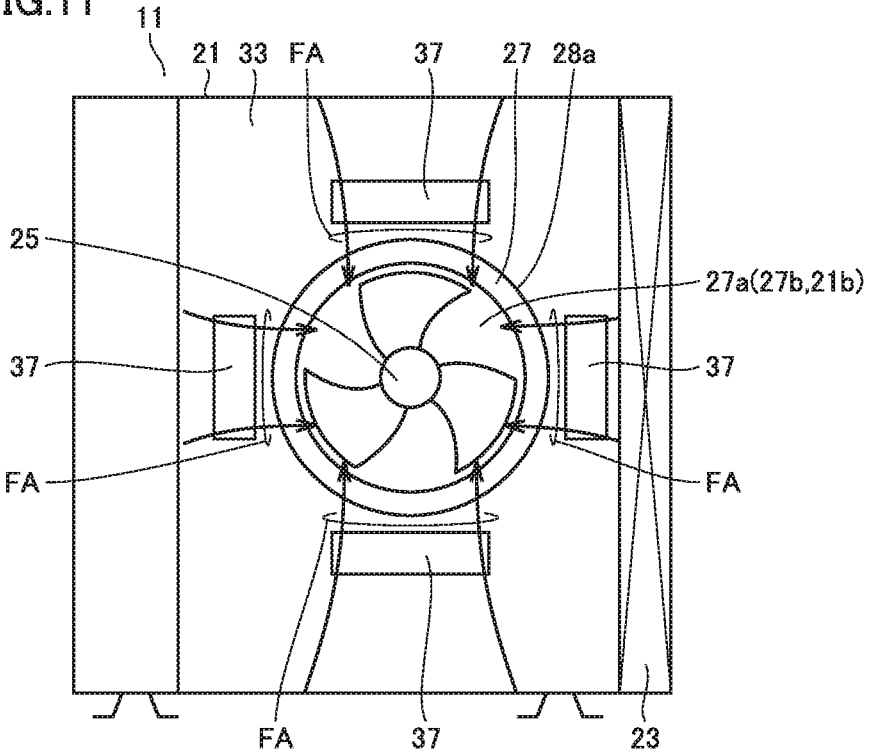
FIG. 11 is a cross sectional view for illustrating operation of the outdoor unit in the third embodiment.

Next, operation of outdoor unit 11 described above will be described. First, an overall flow of air in casing 21 is as described in the first embodiment. As shown in FIG. 11, in particular, air flowing through a region (position) spaced from axial-flow fan 25 in the radial direction once collides with front panel 33, then flows along baffle plate 37, and is guided to first opening 27*a* of bell mouth 27.

Here, as shown in FIG. 2, in outdoor unit 11, heat exchanger 23 is disposed from the rear panel 35 side toward a side panel side of casing 21 in order to improve heat exchange performance. In such an outdoor unit 11, air passing through a portion of the heat exchanger located on the side panel side (a heat exchanger 23*a*) attempts to flow toward the outer wall (outer peripheral surface) of bell mouth 27.

On this occasion, in outdoor unit 11 in accordance with the comparative example having no baffle plate 37 disposed therein (see FIG. 5), a flow of air concentrates on an outer wall portion of bell mouth 27 facing the portion of heat exchanger 23, when compared with the other wall portion of bell mouth 27, and the air flows faster. Thus, a backflow component of the air increases, and the air (flow) separates at the outer wall close to first opening 27*a* of bell mouth 27.

Figure 12:
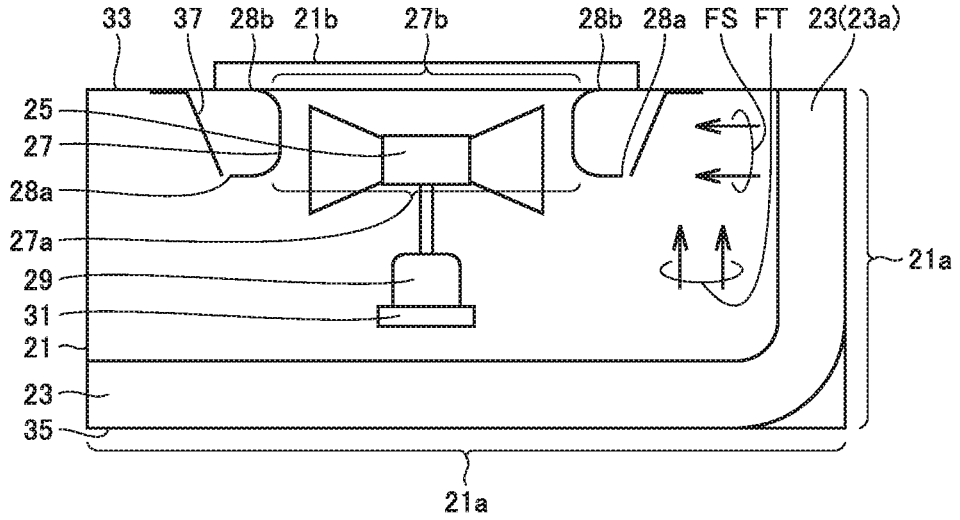
FIG. 12 is a top view for illustrating operation of the outdoor unit in the third embodiment.
Figure 13:
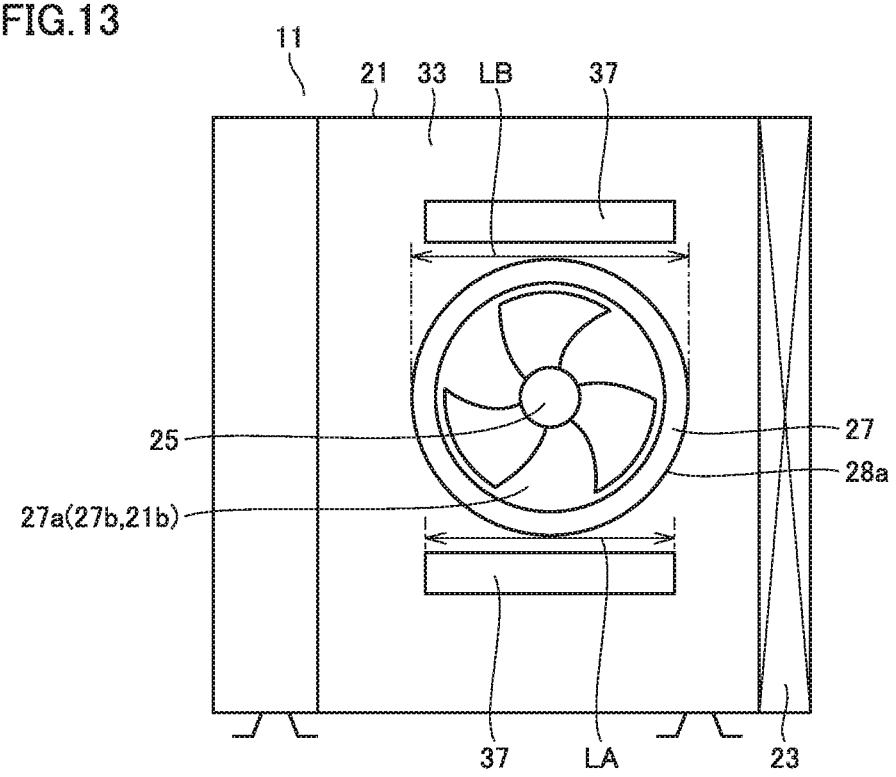
FIG. 13 is a cross sectional view of an outdoor unit in accordance with a fourth embodiment, in a section line corresponding to section line X-X shown in FIG. 2.

In outdoor unit 11 described above, baffle plate 37 is disposed between bell mouth 27 and heat exchanger 23*a* located on the side panel side. Accordingly, as shown in FIG. 12, air passing through heat exchanger 23*a* located on the side panel side (air A: arrows FS) and air passing through a portion of heat exchanger 23 located on the rear panel 35 side (air B: arrows FT) collide with front panel 33, and then flow along baffle plate 37. Air A and air B flowing along baffle plate 37 are exhausted out of casing 21 via bell mouth 27 and air outlet 21*b*.

This can prevent air A and air B from flowing toward the outer wall of bell mouth 27. As a result, the ventilation resistance in outdoor unit 11 can be reduced. In addition, since the ventilation resistance is reduced, efficiency of heat exchange in outdoor unit 11 can be increased, and noise of outdoor unit 11 can be reduced.

It should be noted that a description has been given for a case where four baffle plates 37 are disposed with respect to bell mouth 27 in outdoor unit 11 described above in outdoor unit 11 also having heat exchanger 23 disposed on the side panel side (heat exchanger 23*a*), taking the flow of the air passing through heat exchanger 23*a* described above into consideration, it is desirable to dispose baffle plate 37 at least between bell mouth 27 and heat exchanger 23*a* located on the side panel side.

Further, in the case of an outdoor unit in which the height of a casing is greater than the width of the casing (not shown), the amount of air passing from a rear panel through a heat exchanger and colliding with a front panel increases above and below a bell mouth. In this case, it is desirable to dispose baffle plates at least above and below the bell mouth.

Fourth Embodiment

A fourth example of the outdoor unit will be described. As shown in 13, when viewed in plan view toward the inner surface of front panel 33, baffle plates 37 are disposed above and below bell mouth 27 to sandwich circular bell mouth 27 from above and below directions.

Each of baffle plates 37 is disposed parallel to a tangent at a position of outer circumferential end 28*a* of bell mouth 27 where baffle plate 37 is closest to bell mouth 27. Further, a length LA of baffle plate 37 is set to a length which does not exceed a diameter LB of bell mouth 27 at outer circumferential end 28*a*.

If the length of baffle plate 37 is too long when compared with diameter LB, an end portion of baffle plate 37 in a longitudinal direction is too much spaced from outer circumferential end 28*a* of bell mouth 27. Thus, air flowing in the vicinity of the end portion of baffle plate 37 may collide with front panel 33 again. Therefore, length LA of baffle plate 37 is desirably a length which does not exceed diameter LB.

On the other hand, if the length of baffle plate 37 is too short when compared with diameter LB, air flowing along baffle plate 37 toward outer circumferential end 28*a* of bell mouth 27 may separate from baffle plate 37 along the way. Therefore, length LA of baffle plate 37 is desirably more than or equal to 10% of diameter LB.

Figure 14:
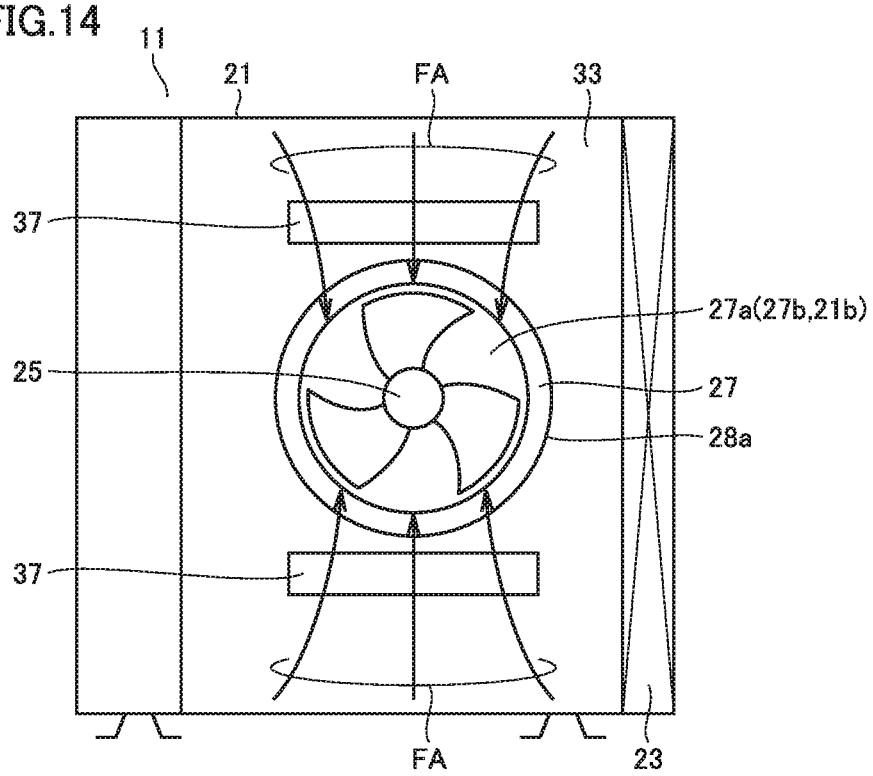
FIG. 14 is a cross sectional view for illustrating operation of the outdoor unit in the fourth embodiment.
Figure 15:
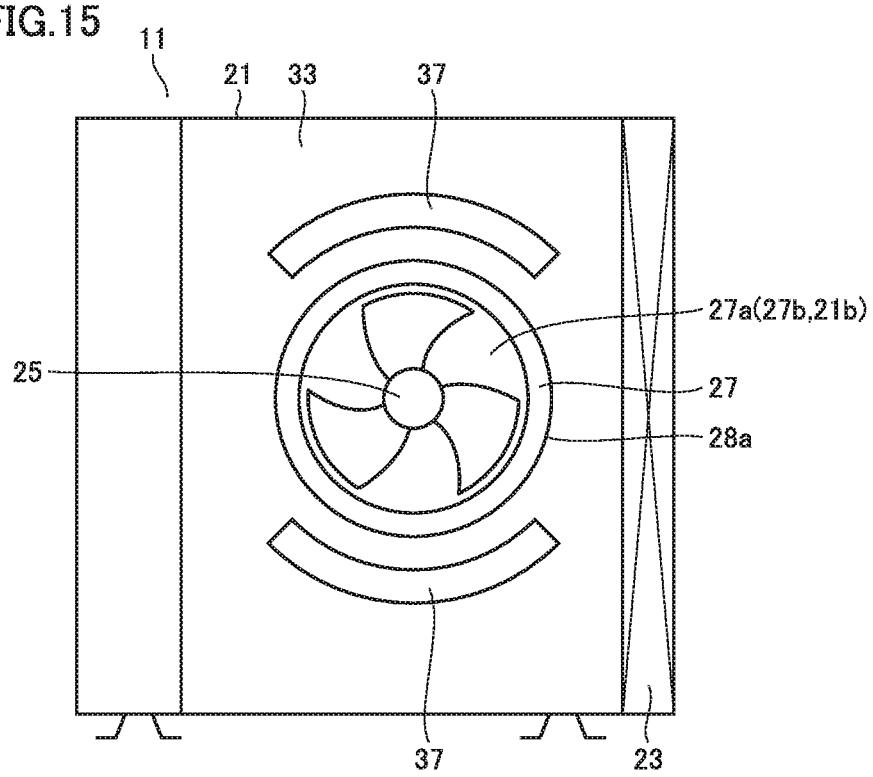
FIG. 15 is a cross sectional view of an outdoor unit in accordance with a fifth embodiment, in a section line corresponding to section line X-X shown in FIG. 2.

Next, operation of outdoor unit 11 described above will be described. First, an overall flow of air in casing 21 is as described in the first embodiment. As shown in FIG. 14, in particular, air flowing through a region (position) spaced from axial-flow fan 25 in the radial direction once collides with front panel 33, then flows along baffle plate 37, and is guided to first opening 27*a* of bell mouth 27.

In outdoor unit 11 described above, length LA of baffle plate 37 is set to a relatively long length in a range in which it does not exceed diameter LB of bell mouth 27 at outer circumferential end 28*a*. Thereby, as described in the first embodiment, this can suppress the air colliding with front panel 33 from attempting to flow along the outer wall (outer peripheral surface) of bell mouth 27 and reduce separation of the air (flow) at the outer wall close to first opening 27*a* of bell mouth 27, over a wider range.

As a result, the ventilation resistance can be reduced. In addition, since the ventilation resistance is reduced, efficiency of heat exchange in outdoor unit 11 can be increased, and noise of outdoor unit 11 can be reduced.

Fifth Embodiment

A fifth example of the outdoor unit will be described. As shown in 15, when viewed in plan view toward the inner surface of front panel 33, baffle plates 37 are disposed above and below bell mouth 27 to sandwich circular bell mouth 27 from above and below directions. Each of baffle plates 37 is disposed in an arc-like manner along outer circumferential end 28*a* of bell mouth 27.

Figure 16:
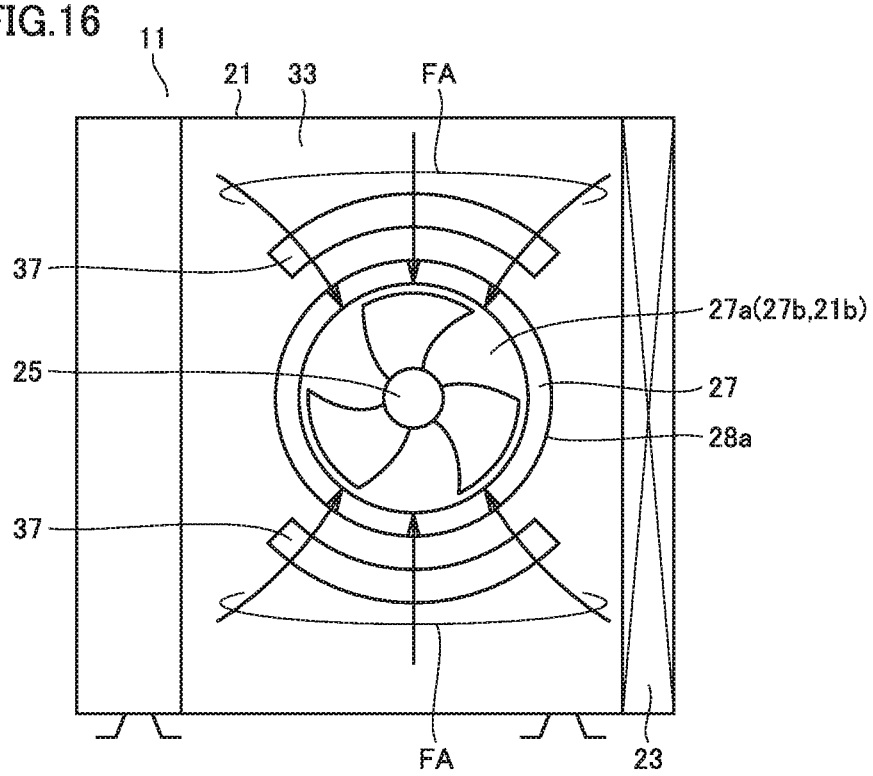
FIG. 16 is a cross sectional view for illustrating operation of the outdoor unit in the fifth embodiment.
Figure 17:
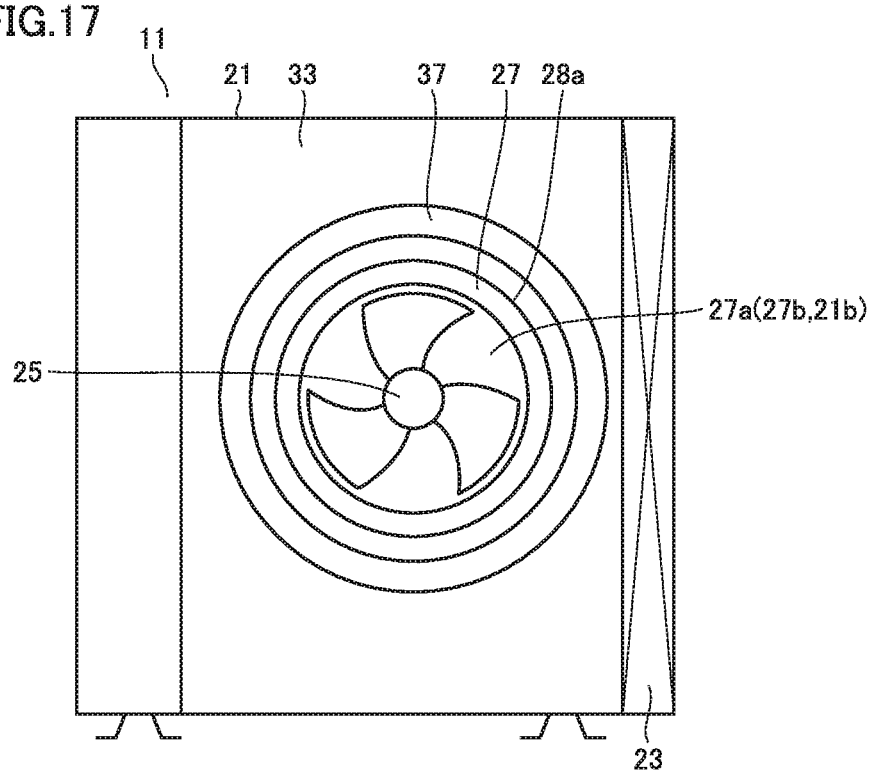
FIG. 17 is a cross sectional view of an outdoor unit in accordance with a sixth embodiment, in a section line corresponding to section line X-X shown in FIG. 2.

Next, operation of outdoor unit 11 described above will be described. First, an overall flow of air in casing 21 is as described in the first embodiment. As shown in FIG. 16, in particular, air flowing through a region (position) spaced from axial-flow fan 25 in the radial direction once collides with front panel 33, then flows along baffle plate 37, and is guided to first opening 27*a* of bell mouth 27.

In outdoor unit 11 described above, since each of baffle plates 37 is disposed in an arc-like manner along outer circumferential end 28*a* of bell mouth 27, the spacing between baffle plate 37 and outer circumferential end 28*a* of bell mouth 27 is substantially constant. Thus, the flow of the air flowing from baffle plate 37 to first opening 27*a* of bell mouth 27 is more stabilized with respect to a circumferential direction of bell mouth 27.

This can suppress the air colliding with front panel 33 from attempting to flow along the outer wall (outer peripheral surface) of bell mouth 27, and effectively reduce separation of the air (flow) at the outer wall close to first opening 27*a* of mouth 27.

As a result, the ventilation resistance can be reduced. In addition, since the ventilation resistance is reduced, efficiency of heat exchange in outdoor unit 11 can be increased, and noise of outdoor unit 11 can be reduced. To obtain such an effect, it is desirable to dispose baffle plate 37 over more than or equal to 10% of an entire circumference of bell mouth 27.

Sixth Embodiment

A sixth example of the outdoor unit will be described. As shown in 17, when viewed in plan view toward the inner surface of front panel 33, ring-shaped baffle plate 37 is disposed to circumferentially surround circular bell mouth 27.

Figure 18:
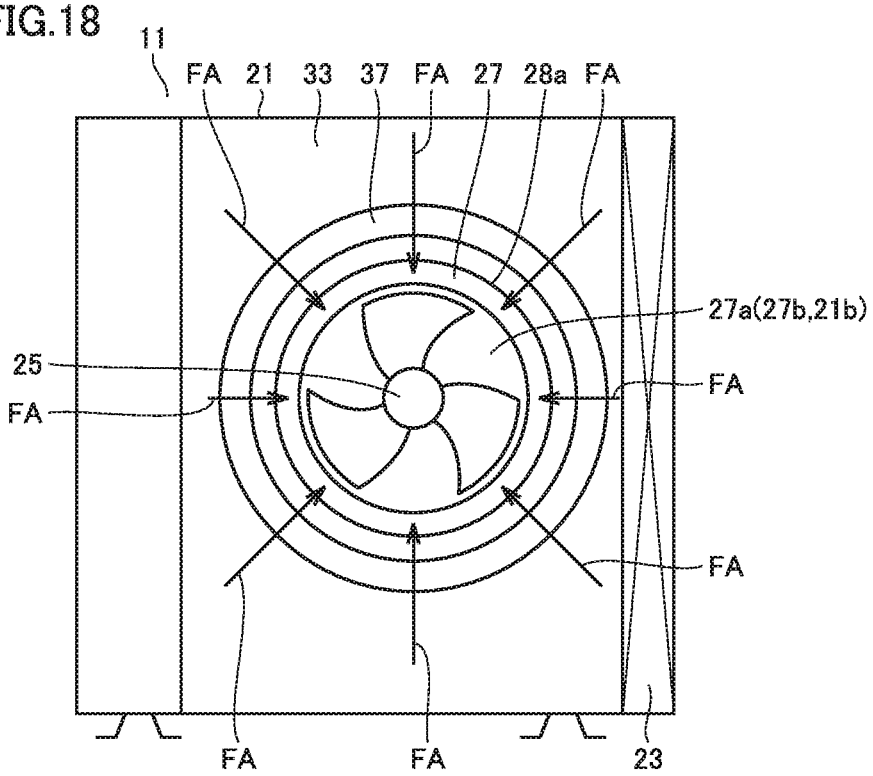
FIG. 18 is a cross sectional view for illustrating operation of the outdoor unit in the sixth embodiment.

Next, operation of outdoor unit 11 described above will be described. First, an overall flow of air in casing 21 is as described in the first embodiment. As shown in FIG. 18, in particular, air flowing through a region (position) spaced from axial-flow fan 25 in the radial direction once collides with front panel 33, then flows along baffle plate 37, and is guided to first opening 27*a* of bell mouth 27.

In outdoor unit 11 described above, since ring-shaped baffle plate 37 is disposed to circumferentially surround circular bell mouth 27, the spacing between baffle plate 37 and outer circumferential end 28*a* of bell mouth 27 is substantially constant over the entire circumference of bell mouth 27. Thus, the flow of the air flowing from baffle plate 37 to first opening 27*a* of bell mouth 27 is further stabilized with respect to the circumferential direction of bell mouth 27.

This can suppress the air colliding with front panel 33 from attempting to flow along the outer wall (outer peripheral surface) or bell mouth 27, and further effectively reduce separation of the air (flow) at the outer wall close to first opening 27*a* of bell mouth 27.

As a result, the ventilation resistance can be reliably reduced. In addition, since the ventilation resistance is reliably reduced, efficiency of heat exchange in outdoor unit 11 can be reliably increased, and noise of outdoor unit 11 can also be reliably reduced. To obtain such an effect, it is desirable to set a gap between baffle plate 37 and outer circumferential end 28*a* of bell mouth 27 to be less than or equal to 30% of diameter LB.

In the embodiments described above, baffle plate 37 extending in one direction, baffle plate 37 extending in an arc-like manner, and ring-shaped baffle plate 37 have been described as examples of baffle plate 37. In embodiments described below, variations of the sectional shape of baffle plate 37 will be described. The sectional shape is a sectional shape in a direction substantially orthogonal to a direction in which baffle plate 37 extends.

Seventh Embodiment

Figure 19:
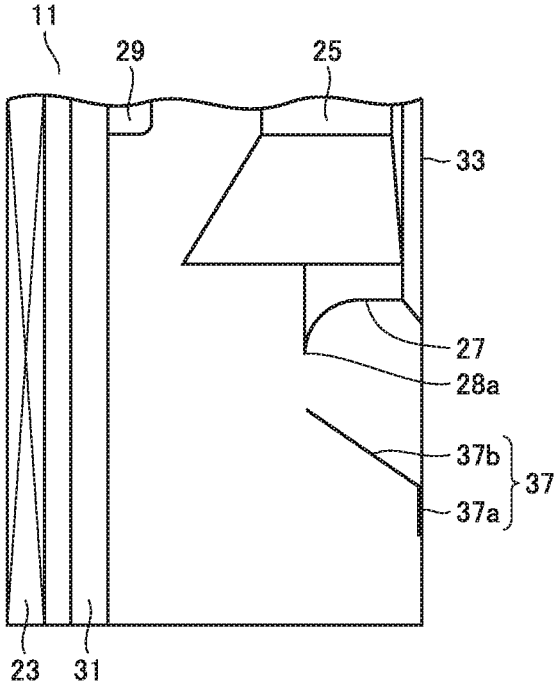
FIG. 19 is a partially enlarged cross sectional view of an outdoor unit in accordance with a seventh embodiment, in a section line corresponding to section line IV-IV shown in FIG. 2.

Here, a first example of the variations of the sectional shape of the baffle plate will be described. In the first embodiment and the like, baffle plate 37 including attached portion 37*a* and inclined portion 37*b* has been described as an example. As shown in FIG. 19, in this baffle plate 37, attached portion 37*a* and inclined portion 37*b* each linearly extend, and inclined portion 37*b* is disposed at a predetermined angle with respect to attached portion 37*a*.

Figure 20:
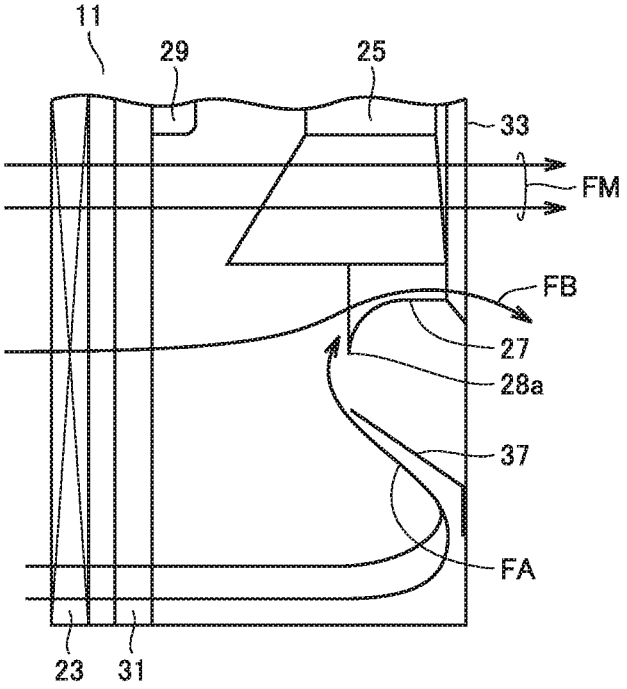
FIG. 20 is a partially enlarged cross sectional view for illustrating operation of the outdoor unit in the seventh embodiment.
Figure 21:
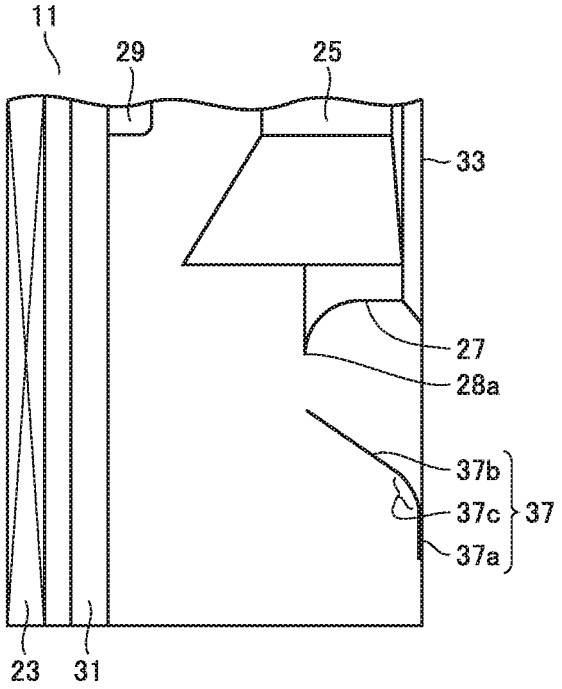
FIG. 21 is a partially enlarged cross sectional view of an outdoor unit in accordance with an eighth embodiment, in a section line corresponding to section line IV-IV shown in FIG. 2.

As shown in FIG. 20, in outdoor unit 11 including such a baffle plate 37, as described in the first embodiment and the like, the air colliding with front panel 33 can be suppressed from attempting to flow along the outer wall (outer peripheral surface) of bell mouth 27. As a result, the ventilation resistance can be reduced. Since the ventilation resistance is reduced, efficiency of heat exchange in outdoor unit 11 can be increased, and noise of outdoor unit 11 can also be reduced.

In addition, since attached portion 37*a* and inclined portion 37*b* each have a linearly extending sectional shape in this baffle plate 37, baffle plate 37 is processed relatively easily, and baffle plate 37 can be easily manufactured.

Eighth Embodiment

Here, a second example of the variations of the sectional shape of the baffle plate will be described. As shown in FIG.

21, baffle plate 37 includes attached portion 37*a*, inclined portion 37*b*, and a curved portion 37*c*. Curved portion 37*c* is disposed between attached portion 37*a* and inclined portion 37*b*. Curved portion 37*c* is formed to protrude toward front panel 33. Curved portion 37*c* smoothly connects attached portion 37*a* and inclined portions 37*b* disposed at a predetermined angle with respect to attached portion 37*a*.

Figure 22:
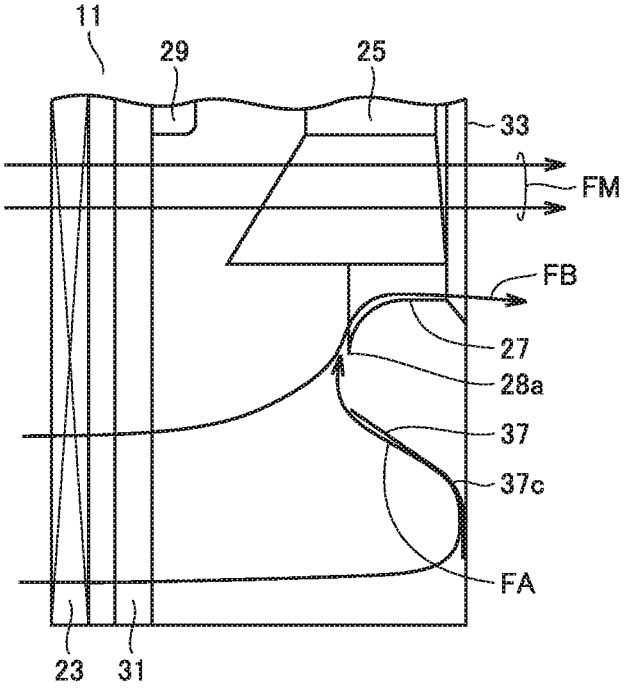
FIG. 22 is a partially enlarged cross sectional view for illustrating operation of the outdoor unit in the eighth embodiment.

As shown in FIG. 22, in outdoor unit 11 including such a baffle plate 37, the air colliding with front panel 33 flows along curved portion 37*c* of baffle plate 37, and then flows along inclined portion 37*b*. Accordingly, the air flows toward inclined portion 37*b* while gradually changing an angle toward inclined portion 37*b* disposed at the predetermined angle with respect to attached portion 37*a*.

Thereby, the ventilation resistance can be further reduced, when compared with a case where an air flow angle changes sharply. In addition, since the ventilation resistance is reduced, efficiency of heat exchange in outdoor unit 11 can be increased, and noise of outdoor unit 11 can also be reduced.

Ninth Embodiment

Figure 23:
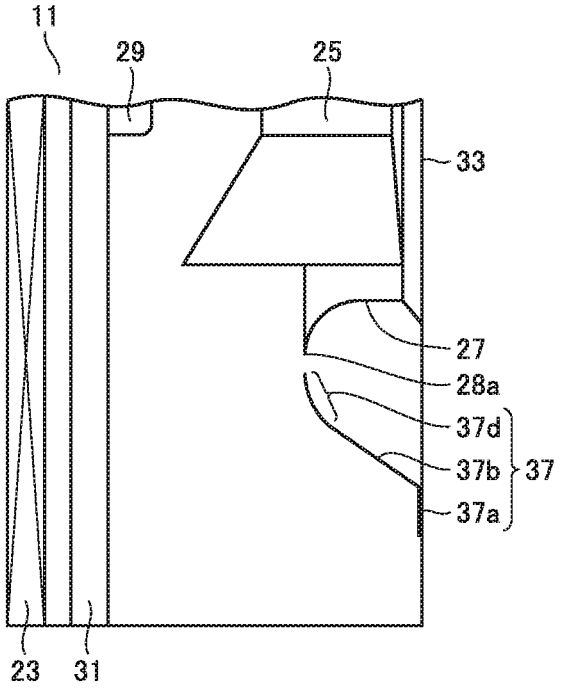
FIG. 23 is a partially enlarged cross sectional view of an outdoor unit in accordance with a ninth embodiment, in a section line corresponding to section line IV-IV shown in FIG. 2.

Here, a third example of the variations of the sectional shape of the baffle plate will be described. As shown in FIG. 23, baffle plate 37 includes attached portion 37*a*, inclined portion 37*b*, and a curved portion 37*d*. Curved portion 37*d* is donned to protrude toward heat exchanger 23. Curved portion 37*d* is formed from inclined portion 37*b* toward outer circumferential end 28*a* of bell mouth 27. Outer circumferential end 28*a* is located on an extension line of a tangent at an end of curved portion 37*d*.

Figure 24:
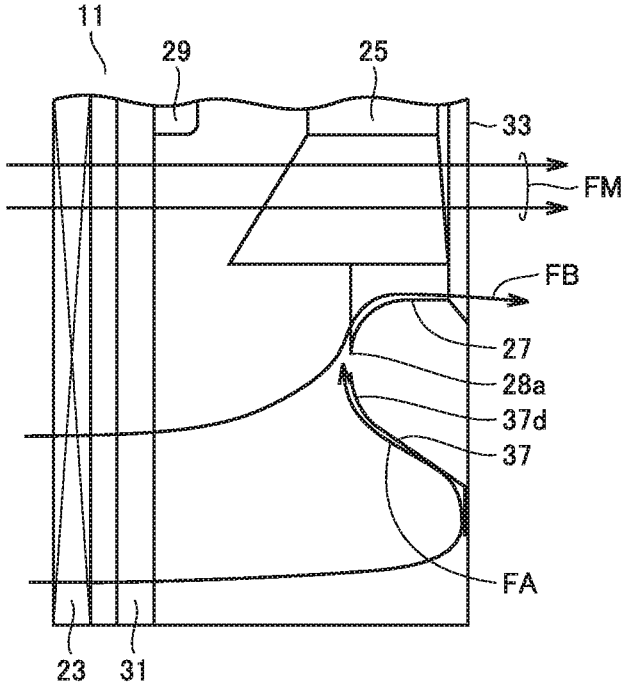
FIG. 24 is a partially enlarged cross sectional view for illustrating operation of the outdoor unit in the ninth embodiment.

As shown in FIG. 24, in outdoor unit 11 including such a baffle plate 37, the air colliding with front panel 33 flows along inclined portion 37*b* of baffle plate 37, then flows along curved portion 37*d*, and flows into first opening 27*a* of bell mouth 27.

On this occasion, since curved portion 37*d* is curved from inclined portion 37*b* toward outer circumferential end 28*a* of bell mouth 27, the air which attempts to flow into first opening 27*a* of bell mouth 27 via curved portion 37*d* easily flows along an inner wall (inner circumferential surface) of bell mouth 27.

Thereby, the ventilation resistance can be further reduced, when compared with a case where no curved portion 37*d* is formed. In addition, since the ventilation resistance is reduced, efficiency of heat exchange in outdoor unit 11 can be increased, and noise of outdoor unit 11 can also be reduced.

Tenth Embodiment

Figure 25:
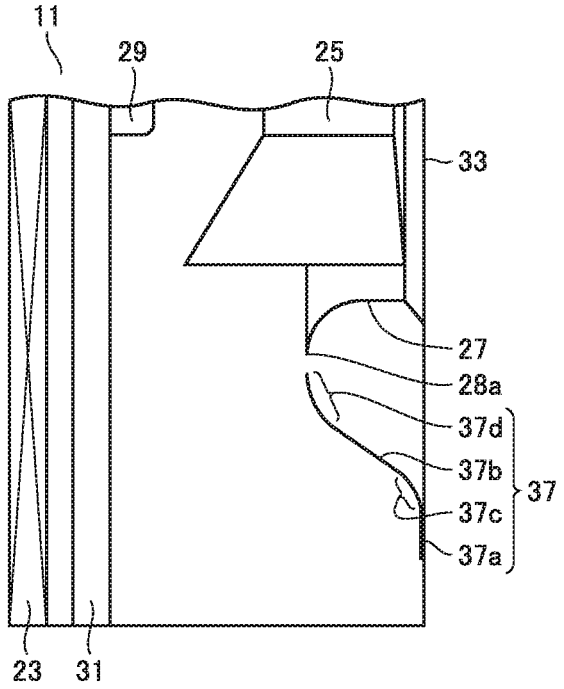
FIG. 25 is a partially enlarged cross sectional view of an outdoor unit in accordance with a tenth embodiment, in a section line corresponding to section line IV-IV shown in FIG. 2.

Here, a fourth example of the variations of the sectional shape of the baffle plate will be described. As shown in FIG. 25, baffle plate 37 includes attached portion 37*a*, curved portion 37*c*, inclined portion 37*b*, and curved portion 37*d*. Curved portion 37*c* is formed to protrude toward front panel 33 for smoothly connecting attached portion 37*a* and inclined portions 37*b*. Curved portion 37*d* is formed to protrude toward heat exchanger 23, and is formed from inclined portion 37*b* toward outer circumferential end 28*a* of bell mouth 27.

Figure 26:
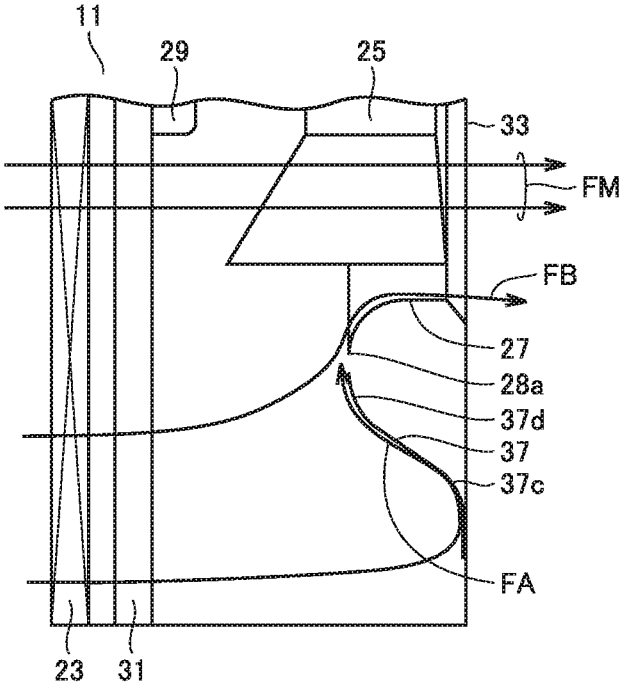
FIG. 26 is a partially enlarged cross sectional view for illustrating operation of the outdoor unit in the tenth embodiment.

As shown in FIG. 26, in outdoor unit 11 including such a baffle plate 37, the air colliding with front panel 33 flows along curved portion 37*c* of baffle plate 37, and then flows along inclined portion 37*b*. The air flowing along inclined portion 37*b* flows along curved portion 37*d*, and flows into first opening 27*a* of bell mouth 27.

Thereby, as described in the eighth and ninth embodiments, the ventilation resistance can be furthermore reduced, when compared with the case where the air flow angle changes sharply and the case where no curved portion 37*d* is formed. In addition, since the ventilation resistance is reduced, efficiency of heat exchange in outdoor unit 11 can be increased, and noise of outdoor unit 11 can also be reduced.

Eleventh Embodiment

Figure 27:
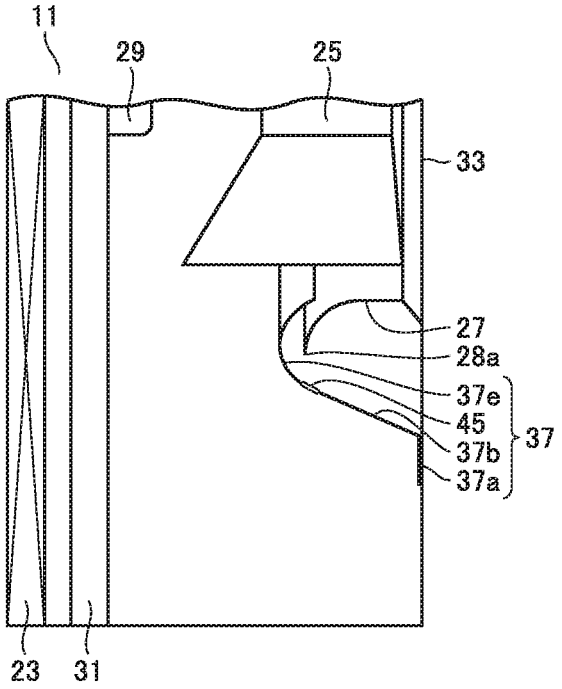
FIG. 27 is a partially enlarged cross sectional view of an outdoor unit in accordance with an eleventh embodiment, in a section line corresponding to section line IV-IV shown in FIG. 2.

Here, a fifth example of the variations of the sectional shape of the baffle plate will be described. As shown in FIG. 27, baffle plate 37 includes attached portion 37*a*, inclined portion 37*b*, and a curved portion 37*e*. Curved portion 37*e* is formed in an arc-like manner to protrude toward heat exchanger 23. Curved portion 37*e* is formed to cover outer circumferential end 28*a* of first opening 27*a* of bell mouth 27 from inclined portion 37*b*. A vent 45 is formed in curved portion 37*e*.

Next, operation of outdoor unit 11 described above will be described. First, it has been described in the second embodiment that air may flow backward at the wall surface of bell mouth 27. Here, this backflow will be described in more detail.

Rotation of axial-flow fan 25 produces a flow in an axial direction (axial component), and a flow in a radial direction (radial component) caused by a centrifugal force associated with the rotation of axial-flow fan 25. Air as a vector with the axial component and the radial component is blown out from bell mouth 27.

Figure 28:
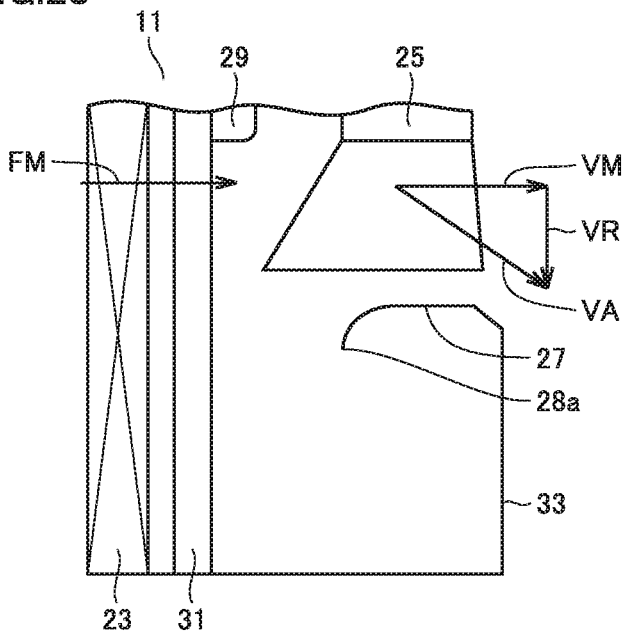
FIG. 28 is a first partially enlarged cross sectional view fir illustrating a flow of air in a bell mouth in the eleventh embodiment.

As shown in FIG. 28, when a desired amount of air passes through heat exchanger 23, the flow in the axial direction (an arrow VM) is strong enough. Thus, an actual flow (an arrow VA) obtained by combining the flow in the axial direction (arrow VM) and the flow in radial direction (an arrow VR) is a flow directed out of bell mouth 27 (casing 21).

Figure 29:
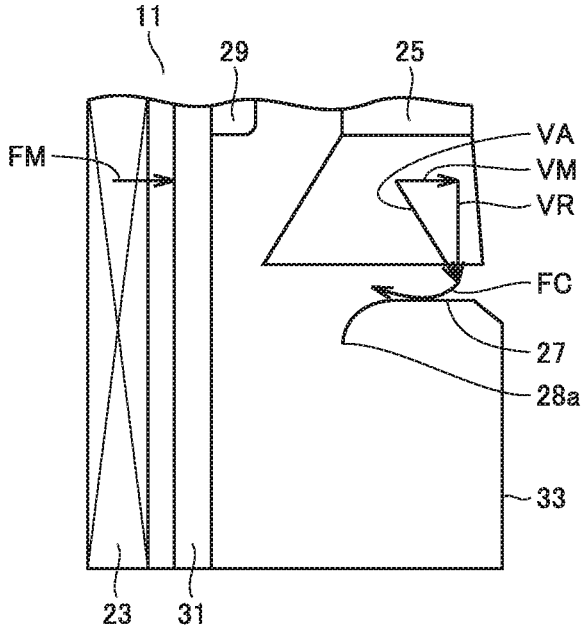
FIG. 29 is a second partially enlarged cross sectional view for illustrating a flow of air in the bell mouth in the eleventh embodiment.

On the other hand, in outdoor unit 11, frost may stick to heat exchanger 23 depending on the operation state of the air conditioner. In that case, as shown in FIG. 29, the amount of air passing through heat exchanger 23 is reduced, and the flow in the axial direction (arrow VM) is relatively weak with respect to the flow in the radial direction (arrow VR).

Thus, an actual flow (arrow VA) obtained by combining the flow in the axial direction (arrow VM) and the flow in radial direction (arrow VR) may include a flow toward the inner wall (inner circumferential surface) of bell mouth 27 (casing 21). Due to this flow of air, air flows back toward heat exchanger 23 (see arrow FC) at the inner wall (inner circumferential surface) of bell mouth 27.

Figure 30:
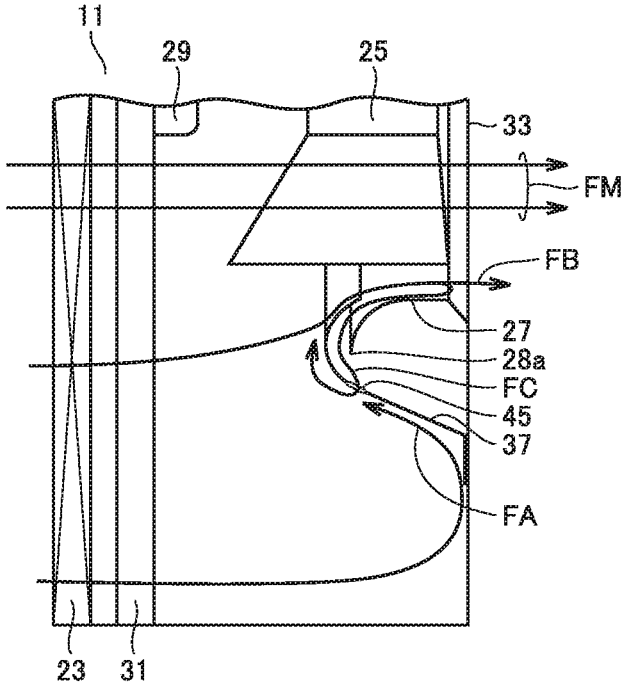
FIG. 30 is a partially enlarged cross sectional view for illustrating operation of the outdoor unit in the eleventh embodiment.

In outdoor unit 11 described above, as shown in FIG. 30, curved portion 37*e* is formed to cover outer circumferential end 28*a* of first opening 27*a* of bell mouth 27. Vent 45 is formed in curved portion 37*e*.

Thereby, the air flowing back toward heat exchanger 23 flows through a gap between bell mouth 27 and baffle plate 37 (curved portion 37*e*). The air flowing through the gap flows along curved portion 37*e* via vent 45, passes through bell mouth 27 again, and is exhausted out of casing 21.

Since the air flowing backward produced in bell mouth 27 passes through bell mouth 27 again and is exhausted out of the casing in this manner, the ventilation resistance can be reduced. In addition, since the ventilation resistance is reduced, efficiency of heat exchange in outdoor unit 11 can be increased, and noise of outdoor unit 11 can be reduced.

It should be noted that various outdoor units including the baffle plates described in the embodiments can be combined as necessary.

The embodiments disclosed herein are illustrative and non-restrictive. The present invention is defined by the scope of the claims, rather than the scope described above, and is intended to include any modifications within the scope and meaning equivalent to the scope of the claims.

INDUSTRIAL APPLICABILITY

The present invention is effectively applicable to an outdoor unit including an axial-flow fan, and an air conditioner including the outdoor unit.

REFERENCE SIGNS LIST

1: air conditioner; 3: compressor; 5: four-way valve; 7: indoor unit; 9: throttle device; 11: outdoor unit; 21: casing; 21*a*: air inlet; 21*b*: air outlet; 23, 23*a*: heat exchanger; 25: axial-flow fan; 27: bell mouth; 27*a*: first opening; 27*b*: second opening; 28*a*, 28*b*: outer circumferential end; 29: fan motor; 31: motor support; 33: front panel; 35: rear panel; 37: baffle plate; 37*a*: attached portion; 37*b*: inclined portion; 37*c*, 37*d*, 37*e*: curved portion; 45: vent; FM, FA, FB, FC, FD, FS, FT, VM, VR, VA: arrow; HA, HB, LA, LB: length.

The invention claimed is:

1. An outdoor unit comprising:

a casing including a first wall portion having an air inlet and a second wall portion having an air outlet;

a heat exchanger disposed in the casing to face the air inlet;

a blowing unit including an axial-flow fan disposed between the heat exchanger and the second wall portion;

a bell mouth disposed on an inner surface of the second wall portion to communicate with the air outlet and circumferentially surround the axial-flow fan; and a baffle plate attached to a position on the inner surface of the second wall portion and dividing the inner surface into a first part and a second part, wherein:

the first part is disposed between the baffle plate and a side wall portion, the second part is disposed between the baffle plate and the bell mouth, the baffle plate is disposed to incline from the position toward where the bell mouth is disposed, the baffle plate is disposed so as to guide air colliding with the first part of the second wall portion to the bell mouth, the bell mouth is disposed on the second part of the second wall portion, and an end portion of the baffle plate closest to the heat exchanger is spaced apart from the heat exchanger.

2. The outdoor unit according to claim 1, wherein the bell mouth includes a first opening opened toward the heat exchanger, and a second opening opened toward the air outlet, and the baffle plate includes a portion extending from the position on the inner surface of the second wall portion toward an outer circumferential end of the first opening of the bell mouth.

3. The outdoor unit according to claim 2, wherein, the baffle plate comprises a plurality of plates which is disposed to surround the bell mouth, and when viewed in plan view toward the inner surface of the second wall portion, the baffle plate is disposed to sandwich the bell mouth from at least a first direction and a second direction.

4. The outdoor unit according to claim 2, wherein a distance from the inner surface of the second wall portion to an end portion of the baffle plate closer to the heat exchanger is longer than a distance from the inner surface of the second wall portion to the outer circumferential end of the bell mouth.

5. The outdoor unit according to claim 2, wherein when viewed in plan view toward the inner surface of the second wall portion, the outer circumferential end of the bell mouth is circular, and the baffle plate is disposed parallel to a direction of a tangent to the outer circumferential end of the bell mouth, with a length which does not exceed a diameter of the bell mouth.

6. The outdoor unit according to claim 2, wherein when viewed in plan view toward the inner surface of the second wall portion, the outer circumferential end of the bell mouth is circular, and the baffle plate is disposed along the outer circumferential end of the bell mouth.

7. The outdoor unit according to claim 2, wherein the baffle plate is disposed along the outer circumferential end of the bell mouth to surround an entire circumference of the outer circumferential end.

8. The outdoor unit according to claim 2, wherein the baffle plate includes a first portion attached to the inner surface of the second wall portion, and a second portion extending from the first portion toward the outer circumferential end of the bell mouth.

9. The outdoor unit according to claim 8, wherein the baffle plate includes a third portion curved to protrude toward the second wall portion for smoothly connecting the first portion and the second portion.

10. The outdoor unit according to claim 8, wherein the baffle plate includes a fourth portion extending from the second portion toward the outer circumferential end of the bell mouth, with being curved to protrude toward the heat exchanger.

11. The outdoor unit according to claim 8, wherein the baffle plate includes a fifth portion covering the outer circumferential end of the bell mouth from the second portion, with being curved to protrude toward the heat exchanger, and extending from the first opening toward the second opening.

12. The outdoor unit according to claim 11, wherein the fifth portion is provided with a through hole.

13. The outdoor unit according to claim 1, wherein the baffle plate and the bell mouth are separate elements.

14. The outdoor unit according to claim 1, wherein the heat exchanger includes a first heat exchange portion facing the air inlet, and a second heat exchange portion extending from the first heat exchange portion toward the second wall portion, and the baffle plate is disposed at a portion of the inner surface of the second wall portion located between the bell mouth and the second heat exchange portion.

15. An air conditioner comprising the outdoor unit according to claim 1.

* * * * *